US006189359B1

(12) United States Patent
Caporusso et al.

(10) Patent No.: US 6,189,359 B1
(45) Date of Patent: Feb. 20, 2001

(54) TWISTING MACHINE FOR POLYGONAL CROSS-SECTION BARS

(75) Inventors: Alessandro Caporusso; Mario Caporusso, both of Piedimonte San Germano (IT)

(73) Assignee: C.M.L. Costruzioni Meccaniche Liri S.r.l., Frosinone (IT)

( * ) Notice: Under 35 U.S.C. 154(b), the term of this patent shall be extended for 0 days.

(21) Appl. No.: 09/409,905

(22) Filed: Oct. 1, 1999

(30) Foreign Application Priority Data

Oct. 1, 1998 (IT) ..... RM98A0621

(51) Int. Cl.[7] ..... B21D 11/14
(52) U.S. Cl. ..... 72/299
(58) Field of Search ..... 72/299, 298, 371

(56) References Cited

U.S. PATENT DOCUMENTS 1,887,375 * 11/1932 Hightower ..... 72/299
2,628,653 * 2/1953 Sherman ..... 72/371
4,019,356 4/1977 Bohl .
5,771,726 6/1998 Bibby et al. .

FOREIGN PATENT DOCUMENTS

75787 * 6/1894 (DE) ..... 72/299
610277 * 3/1935 (DE) ..... 72/299
560041 * 3/1944 (GB) ..... 72/371

* cited by examiner

*Primary Examiner*—Daniel C. Crane
(74) *Attorney, Agent, or Firm*—Young & Thompson

(57) ABSTRACT

A twisting machine for polygonal cross-section bars having an independent jaw chuck fitted on a mandrel and a counteracting support slidable on a prismatic guide, which is firmly connected to the machine and parallel to the mandrel; the jaw chuck includes a mutually co-operating rotary connection between the mandrel and the chuck in the form of a groove for ball-recirculating and a mutually engagement, such as an abutment projection diametrally projecting from and integral with the mandrel and a longitudinal pin connected to the chuck, which are adapted to drive into rotation the chuck by the mandrel, after a free rotation of the mandrel along an arc with an angle less than a round angle.

11 Claims, 1 Drawing Sheet

TWISTING MACHINE FOR POLYGONAL CROSS-SECTION BARS

BACKGROUND OF THE INVENTION

This invention relates to a twisting machine for polygonal cross-section bars. Twisting machines of this kind, called also torsion machines, have an independent jaw chuck firmly fitted on a mandrel and a counteracting support, which is slidely connected to a prismatic guide parallel to the mandrel. A bar to be twisted is centered on the chuck and the support.

DESCRIPTION OF THE RELATED ART

The machines of this kind are affected by a problem related to the type of poly-angular jaws, having in general surfaces at right angle, which are necessary to hold polygonal cross-section bar against the rotation. When a bar has to be centered on the chuck and the counteracting support, their jaws must match, or more properly the space defined by the jaws of the chuck is necessarily equal and angularly equally arranged to the space defined by the counteracting support. One must try to achieve this position of the chuck by rotating the geared motor driving the mandrel, which is difficult to be achieved after several attempts by controlling the machine power.

In twisting machines known a nonius with a pointer indicating precisely the desired position is provided. However, the difficulty in achieving this position is alleviated only a little.

A difficulty similar to that one meets in centering a bar to be twisted is founded in removing the same, when the machining operation is finished or during a step which requires that the points of clamping the bar on the chuck or on the mandrel are changed. Obviously, when the mandrel is stopped, the bar remains stressed. Therefore, until now, in the operation one tries through the control of the geared motor power, to release the bar from the elastic stresses present inside so that the bar doesn't counteract the jaws to be removed.

SUMMARY OF THE INVENTION

A main object of this invention is therefore to provide a twisting machine which allows machining time to be shortened notably.

Another object of this invention is to make easier the steps of centering a bar and removing the same in a safe way for the worker.

These objects are achieved by the present invention which provides, such as defined and characterised broadly in the first one of the accompanying claims and in its more meaningful particular embodiments in the subsequent claims, a twisting machine for polygonal cross-section bars having an independent jaw chuck fitted on a mandrel and a counteracting support slidable on a prismatic guide, which is firmly connected to the machine and parallel to said mandrel, characterised in that said independent jaw chuck comprises mutually co-operating means of rotary connection between said mandrel and said chuck for the free rotation of the chuck;

means of mutually engagement provided on said mandrel and, respectively, on said chuck, which are adapted to drive into rotation said chuck by means of said mandrel, after a free rotation of said mandrel along an arc with an angle less than a round angle.

BRIEF DESCRIPTION OF THE DRAWINGS

The invention is described more in detail below, only by example but not in limiting way, in connection with a preferred embodiment thereof with reference to the accompanying drawing, in which.

DESCRIPTION OF THE PREFERRED EMBODIMENTS

In the figures there are shown a twisting machine designated in general as 1, a hollow mandrel 2 of the twisting machine, an independent jaw chuck 3, a counteracting support 4, and a prismatic guide 5.

Figure 2:
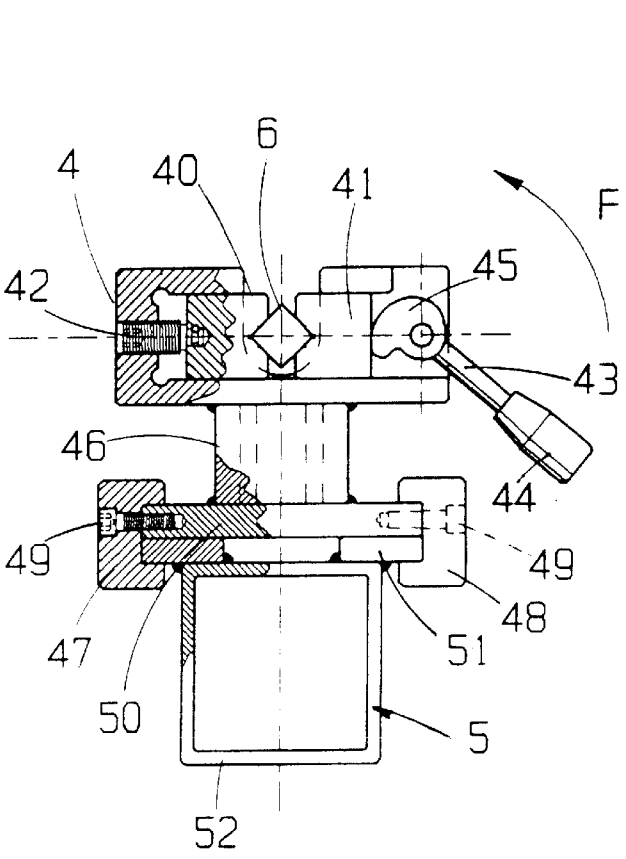
FIG. 2 is a cross-section view taken along line A—A in FIG. 1.
Figure 1:
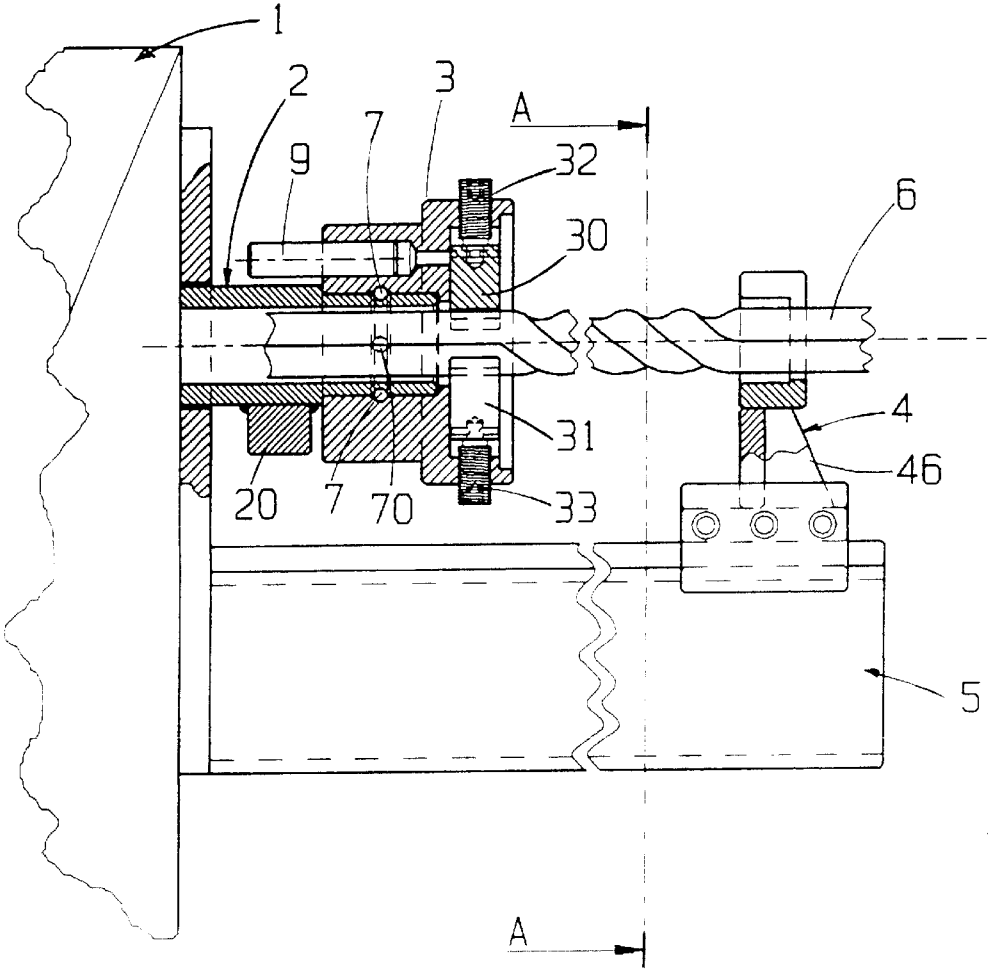
FIG. 1 is a fragmentary side view, partially cross-sectioned, of a twisting machine according to this invention when a square cross-section bar is being worked.

As shown in FIG. 1, a bar 6 to be twisted is centered between the chuck 3 and the counteracting support 4.

Only by way of example, the independent jaw chuck 3 comprises a pair of jaws 30, 31, which have right-angled gripping surfaces and are approachable along a vertical straight movement. The movement of the jaws 30, 31 is controlled by their threaded connection means, i.e. adjusting screws 32, 33.

Further, by way of example, the counteracting support 4 is a vice chuck comprising a pair of jaws 40, 41, which have right-angled gripping surfaces and are approachable along a vertical straight movement. The one jaw 40 is controlled by a threaded connection means 42 in order to make possible that a reference position is fixed depending on a bar to be worked. The other jaw 41 is controlled by an eccentric rod 43 having a handle control 44 and an eccentric 45. The eccentric rod 43 can be operated in the direction of an arrow F in order to move away the jaw 41 from the bar 6 to be worked.

The counteracting support 4 has an upright 46 and, at its bottom, means of running fit with the prismatic guide 5. Such a means of running fit are obtained for example by opposite U-shaped profiles 47, 48, which are connected by screws 49 to a base plate 50 and are free to slide on a lower rail 51 fixed to a tubular element 52 connected to a machine body, both the lower rail 51 and the tubular element 52 constituting the prismatic guide 5.

According to the invention, the independent jaw chuck 3 comprises cooperating means of rotary connection to the hollow mandrel 2 and means of mutually engagement with the hollow mandrel 2.

In an embodiment of the invention said means of rotary connection consist of circumferential grooves having a semicircular cross-section (not denoted by numeral), which are carried out on the external surface of the mandrel 2 and correspondingly on the internal cylindrical surface of the chuck 3 so that the grooves are facing in order to function together as a ball race for balls 7, as in a re-circulating ball device. The circumferential groove of the chuck 3 is communicating with a diametral hole 70 carried out into said groove, said diametral hole being threaded and open into outside for the introduction of the balls and the subsequent closure by means of a security dowel (not shown).

Yet in an embodiment preferred at present, the above said means of mutually engagement are constituted by an abutment projection 20 diametrically projecting from and integral with the mandrel, and a longitudinal pin 9 connected to the chuck. The means of mutually engagement are adapted to rotate the chuck 3 by means of the mandrel 2, after a free rotation of the chuck along an arc with an angle less than a round angle. In another embodiment (not shown) the chuck has a slot extended along a certain arc of circumference in which a pin connected to the mandrel is housed. However, a person skilled in the art can conceive other rotary connections between the mandrel and the chuck.

Although not shown, a revolution counter of the mandrel 2 in the form of a stop microswitch device, by which a number of revolutions may be set in order to achieve a desired twisting effect, can be joined to the twisting machine according to the invention.

The operation of the machine is as follows. In a first step a bar 6 to be twisted is centered readily between the chuck 3 and the counteracting support 4 as the chuck is "idle" or freely rotating on the mandrel 2. In a next step a twisting operation, which is enabled by the driving engagement between the mandrel 2 and the chuck 3 through the longitudinal pin 9 of the chuck 3 and the abutment projection 20 of the mandrel 2. In a third step the twisted bar is removed from the machine. For this purpose the machine turns the bar in the opposite direction to the twisting direction, until the elastic limit of the material of the bar is exceeded. By virtue of the chuck 3 freely rotating on the mandrel 2, the twisted bar is able to be removed from the machine.

The invention so conceived is liable to changes and modification without departing from the scope of the same innovative concept. For example, instead of the free rotation of the mandrel-chuck unit, the counteracting support unit, comprised of the vice chuck and the upright, may be designed to freely rotate. Further, the relative position of the independent jaw chuck and counteracting support may be specularly opposed to that one as described and shown. This invention is applicable also in this arrangement of the machine. Further, all the details may be replaced by technically equivalent elements.

What is claimed is:

1. A twisting machine for polygonal cross-section bars, comprising:

a mandrel;

an independent jaw chuck fitted on the mandrel;

a prismatic guide firmly mounted parallel to the mandrel; and a counteracting support slideable on the prismatic guide;

the independent jaw chuck comprising mutually co-operating a rotary connection means located between the mandrel and the chuck for providing free rotation of the chuck while the mandrel is fixed, and a mutual engagement means provided on the mandrel and on the chuck for driving into rotation the chuck by action of the mandrel after a free rotation of the mandrel along an arc with an angle less than a round angle.

2. The twisting machine of claim 1, wherein the rotary connection means comprises circumferential grooves having a semicircular cross-section on an external surface of the mandrel and a corresponding internal cylindrical surface of the chuck, the circumferential grooves on the mandrel and the chuck together forming a ball race;

balls located within the ball race;

a diametral hole penetrating the chuck to the groove of the chuck, the diametral hole being threaded and open to an exterior of the chuck to provide a path for an introduction of the ball into the ball race; and a security dowel located within the diametral hole acting as a diametral hole closure.

3. The twisting machine of claim 1, wherein the mutual engagement means comprises an abutment projection diametrally projecting from and integral with the mandrel; and a longitudinal pin connected to the chuck.

4. The twisting machine of claim 1, wherein the independent jaw chuck comprises a pair of jaws, the pair of jaws having right-angled gripping surfaces and being approachable along a vertical straight movement; and a threaded connection means for controlling the operation of the pair of jaws.

5. The twisting machine of claim 1, wherein the counteracting support comprises a vice chuck having a pair of jaws, the pair of jaws having right-angled gripping surfaces and being approachable along a vertical straight movement;

a threaded connection means for controlling at least a one of the pair of jaws; and an eccentric rod arranged to control the other of another of the pair of jaws.

6. A twisting machine for polygonal cross-section bars, comprising:

a mandrel;

an independent jaw chuck fitted on the mandrel;

a prismatic guide parallel to the mandrel; and a counteracting support slideable on the prismatic guide;

the independent jaw chuck comprising a rotary connection means located between the mandrel and the chuck for providing free rotation of the chuck, and a mutual engagement means provided on the mandrel and on the chuck for driving into rotation the chuck by action of the mandrel after a free rotation of the mandrel, the rotary connection means comprising circumferential grooves having a semicircular cross-section on an external surface of the mandrel and a corresponding internal cylindrical surface of the chuck, the circumferential grooves on the mandrel and the chuck together forming a ball race;

balls located within the ball race;

a diametral hole penetrating the chuck to the groove of the chuck, the diametral hole having an opening to an exterior of the chuck to provide a path for an introduction of the ball into the ball race; and a diametral hole closure.

7. The twisting machine of claim 6, wherein the independent jaw chuck comprises a pair of jaws, the pair of jaws having right-angled gripping surfaces; and a threaded connection arranged for controlling the operation of the pair of jaws.

8. The twisting machine of claim 6, wherein the counteracting support comprises a vice chuck having a pair of jaws, the pair of jaws having right-angled gripping surfaces;

a threaded connection means controlling a first of the pair of jaws; and an eccentric rod arranged controlling a second of another of the pair of jaws.

9. A twisting machine for polygonal cross-section bars, comprising:

a support;

a mandrel attached to the support plate;

an independent jaw chuck fitted on the mandrel;

a prismatic guide firmly connected to the support and parallel to the mandrel; and a counteracting support slideable on the prismatic guide;

the independent jaw chuck comprising a rotary connection means located between the mandrel and the chuck for providing free rotation of the chuck, and a mutual engagement means provided on the mandrel and on the chuck for driving into rotation the chuck by action of the mandrel, wherein the mutual engagement means comprises an abutment projection diametrally projecting from and integral with the mandrel; and a longitudinal pin connected to the chuck.

10. The twisting machine of claim 9, wherein the independent jaw chuck comprises a pair of jaws, the pair of jaws having right-angled gripping surfaces; and a threaded connection means for controlling the operation of the pair of jaws.

11. The twisting machine of claim 9, wherein the counteracting support comprises a vice chuck having a pair of jaws, the pair of jaws having right-angled gripping surfaces;

a threaded connection means for controlling at least a one of the pair of jaws; and an eccentric rod arranged to control the other of another of the pair of jaws.

* * * * *